US011102849B2

(12) United States Patent
Ceamanos Gaya et al.

(10) Patent No.: US 11,102,849 B2
(45) Date of Patent: Aug. 24, 2021

(54) COOKING DEVICE AND METHOD FOR PRODUCING A COOKING DEVICE

(71) Applicant: BSH Hausgeräte GmbH, Munich (DE)

(72) Inventors: Jesús Ceamanos Gaya, Saragossa (ES); Patricia Gomez Bachiller, Saragossa (ES); Pablo Jesus Hernandez Blasco, Saragossa (ES); Henry Mauricio Mantilla Chacón, Saragossa (ES); Damaso Martin Gomez, Saragossa (ES); Esther Ondiviela Serrano, Saragossa (ES); Marta Osta Lombardo, Tudela (ES); Jesús Ricardo Ruiz Gracia, Movera (ES)

(73) Assignee: BSH Hausgeräte GmbH, Munich (DE)

( * ) Notice: Subject to any disclaimer, the term of this patent is extended or adjusted under 35 U.S.C. 154(b) by 152 days.

(21) Appl. No.: 16/486,160

(22) PCT Filed: Mar. 12, 2018

(86) PCT No.: PCT/IB2018/051605
§ 371 (c)(1),
(2) Date: Aug. 15, 2019

(87) PCT Pub. No.: WO2018/178784
PCT Pub. Date: Oct. 4, 2018

(65) Prior Publication Data

US 2019/0364621 A1 Nov. 28, 2019

(30) Foreign Application Priority Data

Mar. 28, 2017 (ES) ..... ES201730441

(51) Int. Cl.
*H05B 6/12* (2006.01)
*H05B 3/74* (2006.01)

(52) U.S. Cl.
CPC ..... *H05B 6/1218* (2013.01); *H05B 3/746* (2013.01)

(58) Field of Classification Search
CPC .... H05B 6/1209; H05B 6/1218; H05B 3/742; H05B 3/746
(Continued)

(56) References Cited

U.S. PATENT DOCUMENTS 5,448,036 A 9/1995 Husslein et al.
6,300,602 B1 10/2001 Platt et al.
(Continued)

FOREIGN PATENT DOCUMENTS

EP 1273851 A2 1/2003
EP 1903284 A1 3/2008
(Continued)

OTHER PUBLICATIONS

National Search Report ES 201730441 dated Apr. 26, 2018.
International Search Report PCT/IB2018/051605 dated Jun. 15, 2018.

*Primary Examiner* — Hung D Nguyen
(74) *Attorney, Agent, or Firm* — Michael E. Tschupp; Andre Pallapies; Brandon G. Braun

(57) ABSTRACT

A cooking device includes a light unit and an insulation unit configured to electrically insulate the light unit. The insulation unit includes a first insulation element and a second insulation element, with the light unit being at least partially arranged between the first insulation element and the second insulation element.

29 Claims, 2 Drawing Sheets

(58) Field of Classification Search
USPC ..... 219/471, 483, 487, 489, 490, 502, 506, 219/620, 625
See application file for complete search history.

(56) References Cited

U.S. PATENT DOCUMENTS

| | | | | |
|---|---|---|---|---|
| 6,777,884 | B1 | 8/2004 | Barnardo et al. | |
| 8,199,544 | B2 * | 6/2012 | Krause | H02M 7/5387 363/132 |
| 2010/0234237 | A1 * | 9/2010 | Yoo | F16K 99/0001 506/9 |
| 2011/0233196 | A1 | 9/2011 | Bunuel Magdalena et al. | |
| 2015/0351163 | A1 | 12/2015 | Kim et al. | |

FOREIGN PATENT DOCUMENTS

| | | | | |
|---|---|---|---|---|
| EP | 2192350 | A1 * | 6/2010 | A47L 15/4293 |
| JP | 2008277097 | A | 11/2008 | |
| WO | 9903158 | | 1/1999 | |
| WO | 2014060919 | A2 | 4/2014 | |

* cited by examiner

COOKING DEVICE AND METHOD FOR PRODUCING A COOKING DEVICE

CROSS-REFERENCES TO RELATED APPLICATIONS

This application is the U.S. National Stage of International Application No. PCT/IB2018/051605, filed Mar. 12, 2018, which designated the United States and has been published as International Publication No. WO 2018/178784 A1 and which claims the priority of Spanish Patent Application, Serial No. P201730441, filed Mar. 28, 2017, pursuant to 35 U.S.C. 119(a)-(d).

BACKGROUND OF THE INVENTION

The invention relates to a cooking and a method for producing a cooking device.

Cooking devices in particular for induction cooktops with Light-Emitting Diodes (LED) for displaying status information and/or an activity of inductions cooking zones and with a insulation unit are known from the prior art, wherein the insulation unit is provided for electrical insulation of the LEDs from an electronics unit and/or an induction heating unit of the induction cooktop. In particular over the course of the development of induction cooktops, the distances between induction heating units, LEDs and electronics units have become ever smaller, as a result of which known insulation units, which have until now been embodied as PCI disks, are no longer adequate to meet relevant safety standards.

BRIEF SUMMARY OF THE INVENTION

The object of the invention is in particular to provide a generic device with improved properties in relation to electrical insulation. According to the invention the problem is solved by the features of claim 1 and the features of claim 12, while advantageous embodiments and developments of the invention can be derived from the subclaims.

The invention is based on a cooking device with at least one light unit and with at least one insulation unit, which is provided for electrical insulation of the light unit.

It is recommended that the insulation unit has a first insulation element and at least one second insulation element, between which the light unit is at least partially arranged. By means of this embodiment insulation of the light unit can in particular be improved and in addition stability of the insulation unit increased, as a result of which material, production and maintenance costs, as well as assembly effort, can be reduced.

In this connection a "cooking device" should in particular be understood to mean at least one part, in particular a subassembly of a cooking appliance, in particular of an oven, a grill appliance, a microwave oven and/or preferably a cooktop. The cooking appliance is here advantageously embodied as an induction cooking appliance, in particular as an induction oven, an induction grill appliance, an induction microwave oven, and/or particularly preferably as an induction cooktop. The cooking device preferably comprises at least one heating unit, which is embodied as an induction heating unit. In particular the heating unit has at least one heating element, which although it could be embodied as a burner heating element, a gas heating element and/or a resistance heating element, is however in the present case preferably embodied as an induction heating unit. In particular the heating unit has a multiplicity of in particular structurally identical heating elements, arranged regularly relative to each other. The cooking device additionally comprises at least one control unit for control of the heating unit, at least one light unit, in particular for illumination of the cooktop and/or advantageously for indicating an operating function, and advantageously at least one insulation unit, in particular for electrical insulation of the light unit. Further, a "light unit" in particular should be understood to mean a unit which in particular is provided, in at least one operational status, in particular a lighting operational status, to emit light, advantageously visible light. In particular the light unit can here be provided to illuminate, light up and/or backlight at least one component of the cooking device. The light unit can here advantageously be provided for delivery of an indicator function, preferably to indicate an activity of the cooking appliance and/or to indicate operating parameters. In particular to this end the light unit comprises at least one light element, advantageously a multiplicity of light elements, and particularly advantageously at least one support element, which advantageously is provided for accommodation and/or arrangement of the light element and/or the multiplicity of light elements, in particular by means of an electrical connection to electrical contacts of the support element, in particular by means of welded and/or soldered connections. Advantageously the support element is at least partially embodied as a circuit board, in particular as a Printed Circuit Board (PCB), and at least partially embodied in electrically conductive form and in particular provided to connect at least one light element, advantageously a multiplicity of light elements, to an electrical power supply, in a lighting operational status. In this connection a "lighting operational status" should in particular be understood to mean an operational status of the light unit in which the light unit illuminates in particular at least one light element, a cooking appliance, in particular of a cooktop, for an operating and/or indication function.

An "insulation unit" should in particular be understood to mean a unit with at least one insulation element, in particular a multiplicity and preferably two insulation elements, wherein an insulation element consists at least partially, preferably at least for the most part and particularly preferably completely, of an advantageously electrically insulating material and in particular is provided to insulate the light unit from a further object. The insulation unit in particular comprises at least two insulation elements, in particular a first insulation element and a second insulation element, which are preferably embodied as flat insulation elements and in particular are arranged on two oppositely facing sides of the light unit. In particular at least the first insulation element is provided in particular for electrical insulation of the light unit, in particular of the support element, from the control unit, in particular for insulation from voltages present at electrical contacts of the control unit and currents flowing in the control unit, and viewed in the installation position is arranged underneath the light unit, in particular underneath the support element. Furthermore at least the second insulation element is advantageously embodied for electrical insulation of the light unit, in particular the support element embodied as a circuit board, from the heating unit, in particular for insulation from voltages present at electrical contacts of the heating unit and currents flowing in the induction elements, and in particular provided for electrical insulation from a mounting and/or shield plate of the heating unit, and viewed in an installation position advantageously arranged above the light unit, in particular above the support element. The insulation elements are advantageously in particular connected to the light unit in a force- and/or form-fitted manner. The phrase "the insulation unit has at least two insulation elements, between which the light unit is at least partially arranged", should in particular be understood to mean that viewed in a direction in particular parallel to a main extension plane of at least one insulation element, in particular to the main extension plane of the two insulation elements, and in particular viewed in a direction perpendicular to the main extension plane at least of the one insulation element, in particular to main extension planes of the two insulation elements, the light unit is arranged between the two insulation elements. The "main extension plane" of an object should in particular be understood to mean a plane which is parallel to a largest lateral face of a smallest, in particular notional, cuboid, which only just completely encloses the object, and which in particular runs through a center, in particular a geometric center, of the cuboid. The word "provided" should in particular be understood to mean specially programmed, designed and/or equipped. That an object is provided for a particular function should in particular be understood to mean that the object fulfills and/or performs this particular function in at least one usage and/or operational status.

In order to provide an advantageously space-saving insulation unit, in a preferred embodiment of the invention it is recommended that at least one of the insulation elements, in particular the first insulation element and/or the second insulation element, is embodied in flat form with a maximum material thickness of at most 2 mm. In particular at least one of the insulation elements, in particular the first insulation element and/or the second insulation element, is embodied with a maximum material thickness of at least 0.05 mm, advantageously at least 0.1 mm and particularly preferably at least 0.2 mm. In particular at least one of the insulation elements, in particular the first insulation element and/or the second insulation element, is embodied with a maximum material thickness of at most 2 mm, advantageously at most 1 mm and particularly preferably at most 0.5 mm. Although a material thickness of the first insulation element could diverge from the material thickness of the second insulation element, preferably at least the first insulation element has a material thickness which corresponds to the material thickness of the second insulation element. In particular a first insulation element and/or a second insulation element can have material thicknesses differing from each other in different areas, for example in a contact area and/or a central area. In addition, the insulation unit can in particular have further insulation elements, which have a material thickness diverging from the first insulation element and/or from the second insulation element or corresponding to these. In this connection a "material thickness" should in particular be understood to mean a dimension of an object which in particular runs along a straight line perpendicular to a main extension plane of the object.

It is additionally recommended that the light unit comprises at least one light element and at least one of the insulation elements, in particular the first and/or the second insulation element, and at least one light recess, in particular opening, assigned to the light element. In particular a "light recess" should be understood to mean a recess, in particular an opening of an object, in particular of an insulation element which is provided so that a beam of light emanating from a light element arranged on the object can optically shine from a first side of the object, in particular of the insulation element, to a second side of the object, in particular of the insulation element, facing away from the first side. In particular at least one insulation element has at least one light recess, which is provided to at least partially surround at least one light element along a main extension plane of the at least one insulation element. In this connection, "at least partially surround" should in particular be understood to mean that the one insulation element clasps and/or surrounds the light unit, in particular the light element, in a form-fitted manner, in a peripheral direction at least in areas and/or in sections. In particular at least one light element is enclosed by at least one insulation element, at least viewed in a direction perpendicular to a main extension plane of the insulation element at least for the most part in a peripheral direction. Advantageously in particular at least one of the insulation elements has a multiplicity of light recesses, wherein in particular a light element is assigned to each of the openings of an insulation element. A more efficient insulation of the light unit, in particular of the light elements and advantageously of the support element, and a space-saving insulation unit can advantageously thereby be achieved.

It is furthermore recommended that at least one of the insulation elements, in particular the first and/or the second insulation element, is in contact with the light unit. In particular the first insulation element and/or the second insulation element are connected to the light unit in a force- and/or form-fitted manner and/or preferably in a bonded manner, in particular by means of an adhesive, melting and/or welding method. In particular a particularly stable and advantageously efficient insulation unit can thereby be achieved.

In particular in order to achieve an advantageously space-saving insulation unit and in particular improved stability of an insulation unit, it is recommended that the insulation elements, in particular the first insulation element and the second insulation element, are arranged at least essentially parallel to each other. The phrase "at least essentially parallel" should further in particular be understood to mean an orientation of a direction relative to a reference direction, in particular in one plane, wherein the direction has a deviation vis-à-vis the reference direction in particular of less than 8°, advantageously less than 5° and particularly advantageously less than 2°.

It is additionally recommended that at least one of the insulation elements, in particular the first and/or the second insulation element, is embodied in one piece. "In one piece" should in particular be understood to mean at least connected in a bonded manner and/or embodied with each other. The bonding can for example be created by means of an adhesive process, a spray process, a welding process, a soldering process and/or another process. In one piece should advantageously be understood to mean formed from one piece and/or in one piece. Stability of the insulation unit can thereby advantageously be improved, and manufacturing costs and maintenance effort advantageously reduced.

In order in particular to achieve an improved stability and advantageously simplified usage and a reduction in manufacturing and/or storage costs, in a preferred embodiment of the invention it is recommended that the insulation elements, in particular the first insulation element and the second insulation element, are embodied at least essentially and preferably completely structurally identical to each other. Here, "at least essentially structurally identical" objects should be understood to mean in particular objects which differ from each other in relation to a mass and/or volume percentage of at most 10%, in particular maximum 5% and preferably maximum 1%. In particular the insulation elements can have identical external forms to each other, in particular identical profiles to each other, wherein the external forms of the insulation elements in particular are embodied in each case at least essentially in rectangular form. In this connection that an external form is embodied "at least essentially in rectangular form", should in particular be understood to mean an external form, in particular a profile, which diverges from a rectangular external form by at most 30%, advantageously at most 20% and particularly advantageously at most 10%. In particular external forms of the insulation elements could also alternatively be embodied in a square, circular, and/or trapezoidal form. In particular the first insulation element and the second insulation element can differ in that in particular the second insulation element has light recesses, in particular light recesses already introduced at the top, wherein the first insulation element is embodied to be devoid of light recesses.

In particular the insulation elements can be embodied from plastic, glass, a mineral material and/or an organic material, in particular the two insulation elements can be embodied from different materials. In one preferred embodiment of the invention it is however recommended that at least one of the insulation elements, in particular the first insulation element and/or the second insulation element, is embodied at least partially from mica. That an insulation element is "embodied at least partially from mica" should in particular be understood to mean that the insulation element consists of at least 70%, preferably at least 80%, advantageously at least 85%, particularly preferably at least 90% and particularly advantageously at least 95% of mica. The insulation elements preferably consist completely of mica. In particular particularly light insulation elements can thereby be manufactured and advantageously improved insulation achieved.

It is further recommended that the light unit in particular is manufactured at least essentially in pancake design and comprises at least one support element, which is embodied at least partially in strip-like form, and a multiplicity of light elements, which are arranged on the support element. That "the light unit is manufactured at least essentially in pancake design", should in particular be understood to mean that an object, in particular the first insulation element and/or the second insulation element, has an extent which is parallel to a smallest lateral surface and in particular is parallel to the shortest lateral edge of a smallest notional cuboid, which just completely surrounds the modular unit, and in particular runs through the center point of the cuboid and which has at least one tenth, advantageously at least one fiftieth, preferably at least one hundredth and particularly preferably at least one two-hundredth of the longitudinal extension direction of the light unit. In this connection an "at least partially strip-like form" should in particular be understood to mean a form of an object which at least in areas and/or in sections is embodied with a longitudinal extension with an at least partially strip-like form. A "longitudinal extension" of an object should in particular be understood to mean an extension of the object along a longitudinal extension direction of the object. A "longitudinal extension direction" of an object should in particular be understood to mean a direction which is oriented parallel to a longest side of a smallest notional geometric cuboid which only just completely surrounds the object. In particular the light elements are embodied as LEDs and preferably emit the same wavelength, wherein the light elements could alternatively be embodied as LEDs differing from each other and could emit wavelengths differing from each other. A particularly efficient insulation with an advantageously improved lighting function can thereby in particular be provided. In addition, stability of the insulation unit can advantageously be increased.

For advantageously improved stability and in particular more efficient insulation with an additionally enhanced lighting function, in the preferred embodiment of the invention it is further recommended that the cooking device has at least one further light unit, which is embodied in an at least essentially structurally identical manner to the light unit and which in particular is arranged at least partially between the two insulation elements, wherein the further light unit in particular is arranged on a side of the two insulation elements lying opposite the light unit and comprises at least one of the insulation elements, in particular the second insulation element, in particular at least one further light recess assigned to the further light element, and in particular at least one of the insulation elements is in contact with the further light unit. By means of this embodiment, efficiency of the insulation the light unit can in particular be improved and in addition stability of the insulation unit advantageously improved, as a result of which material, manufacturing and maintenance costs, as well as assembly effort, can be reduced. Additionally in particular a parallel arrangement of the insulation elements can be facilitated, by means of which a particularly stable and consequently efficient insulation unit can be achieved.

A method for production of a cooking device is also recommended, wherein at least one light unit and in particular a further light unit are arranged at least partially between at least two insulation elements of an insulation unit. By means of this embodiment insulation of the light unit can in particular be improved and in addition stability of the insulation unit increased, as a result of which material, manufacturing and maintenance costs, as well as assembly effort, can be reduced.

Further advantages emerge from the following description of the drawings. The drawings show an exemplary embodiment of the invention. The drawings, the description and the claims contain numerous features in combination. The person skilled in the art will expediently also consider the features individually, and put them together into sensible further combinations.

BRIEF DESCRIPTION OF THE DRAWINGS

Wherein.

DETAILED DESCRIPTION OF EXEMPLARY EMBODIMENTS OF THE PRESENT INVENTION

Figure 1:
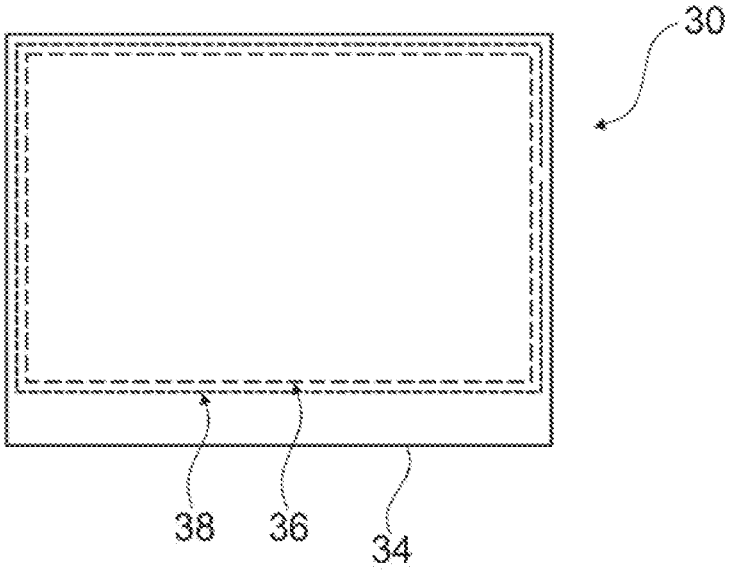
FIG. 1 shows a cooking appliance embodied as a cooktop with a cooking device viewed from above.

FIG. 1 shows a cooking appliance 30 viewed from above. The cooking appliance 30 is embodied as a cooktop. The cooking appliance 30 is by way of example embodied as an induction cooktop. The cooking appliance 30 is provided for heating cookware by means of induction. A cooking appliance can alternatively be embodied as a resistance cooktop, a radiation cooktop and/or gas cooktop. The cooking appliance 30 comprises a cooktop hotplate 34, upon which the cookware to be heated can be arranged.

Figure 2:
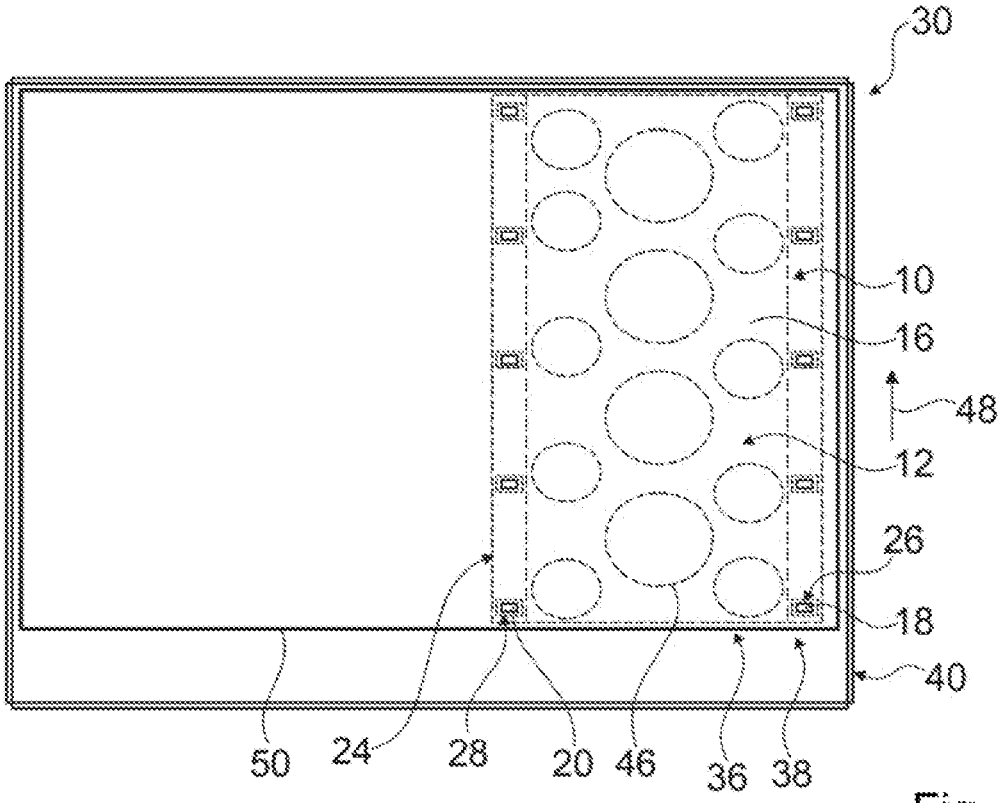
FIG. 2 shows a part of the cooking device viewed from above.

FIG. 2 shows the cooking appliance 30 with cooktop hotplate 34 removed, viewed from above. The cooking appliance 30 comprises a cooking device. The cooking device comprises a housing unit 40. The housing unit 40 is embodied as an accommodation housing. The housing unit 40 is provided to accommodate at least a majority of the components required for operation of the cooking device.

The cooking device comprises at least one heating unit 36 (cf. also FIG. 1). The heating unit 36 is arranged in the housing unit 40. The heating unit 36 is arranged underneath the cooktop hotplate 34. The heating unit 36 is arranged above a mounting and/or shield plate 50. The heating unit 36 is connected to the mounting and/or shield plate 50 in a force- and/or form-fitted manner. In the present case the mounting and/or shield plate 50 is manufactured from aluminum. The heating unit 36 is provided to heat cookware, which is arranged on the cooktop hotplate 34, by means of heat energy. In the present case the heating unit 36 has a multiplicity of induction heating elements, which are not shown here. These are arranged above the mounting and/or shield plate 50. The induction heating elements are connected to the mounting and/or shield plate 50 in a force- and/or form-fitted manner.

The cooking device comprises an electronics unit 38. The electronics unit 38 is arranged in the housing unit 40. The electronics unit 38 is arranged partially underneath the heating unit 36. The electronics unit 38 is arranged underneath the mounting and/or shield plate 50. The electronics unit 38 is at least partially electrically connected to the heating unit 36 at least by means of electrical cables. The electronics unit 38 is provided for a control and/or regulation function, for an operating function performed by a user and/or for a sensor function. The electronics unit 38 is embodied as a control- and/or regulation unit, as an operating unit and/or as a sensor unit.

The cooking device comprises at least one light unit 10 (cf. FIG. 2). The light unit 10 is arranged in the housing unit 40. The light unit 10 is partially arranged between the electronics unit 38 and the heating unit 36. The light unit 10 is arranged underneath the heating unit 36. The light unit 10 is arranged underneath the mounting and/or shield plate 50. The light unit 10 is provided for an illumination function. The light unit 10 is provided for a display function. The light unit 10 is provided to display cooking parameters of the cooktop.

Alternatively or additionally a light unit can be provided for indication of an activity of a cooking device, in particular of a cooktop and/or of induction heating elements, for the indication of cooking parameters and/or for illumination for the purposes of the design appeal of a cooking device, in particular of a cooktop for example in a standby mode and/or in a heating operational status.

Figure 3:
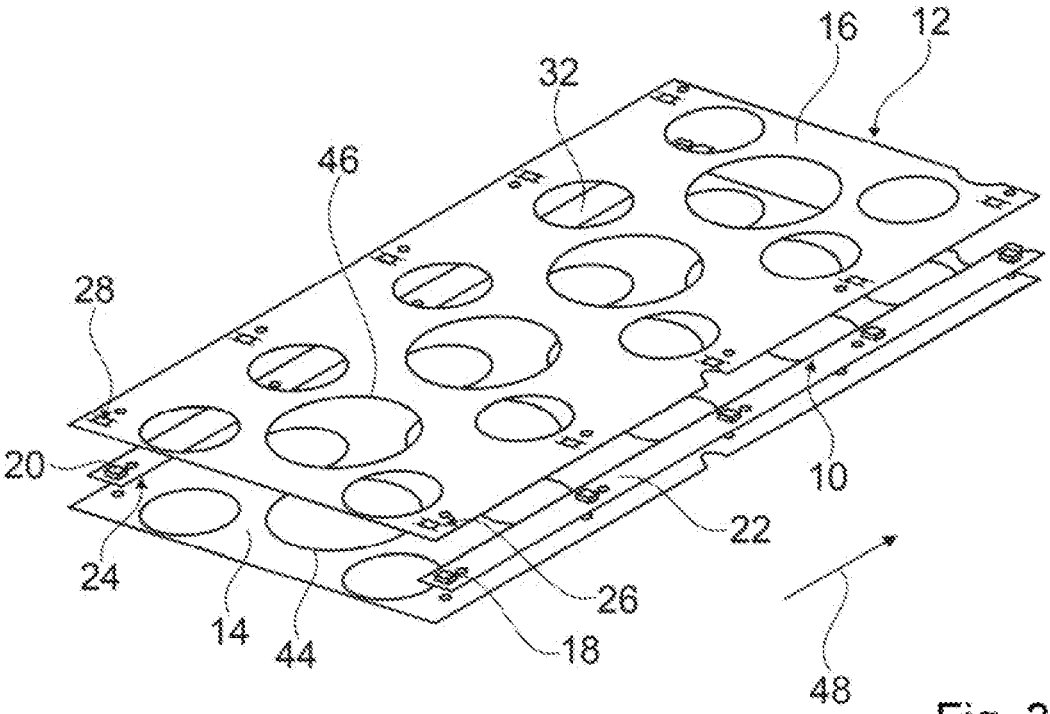
FIG. 3 shows an insulation unit and a light unit of the cooking device in a perspective view and FIG. 4 shows a detail view of a light recess of the insulation unit, which surrounds a light element of the light unit.

FIG. 3 shows a part of the cooking device. For an illumination function the light unit 10 has at least one light element 18. The light element 18 is provided for illumination of the cooktop. The light element 18 is embodied as a Light-Emitting Diode (LED). The light element 18 emits light in an optically visible wavelength range, for example in the red wavelength range between 630 nm and 650 nm and/or a blue wavelength range between 450 nm and 470 nm. The light element 18 shines through the cooktop hotplate 34. Alternatively a light element could also be embodied as a halogen lamp, gas discharge lamp and/or incandescent lamp.

The light unit 10 comprises additional light elements. The additional light elements are embodied in a structurally identical manner to the light element 18. The description of the light element 18 can thus be transferred to the additional light elements, for which reason a further description of the additional light elements can be dispensed with.

The light unit 10 comprises at least one support element 22. The support element 22 is provided to support the light element 18 and the additional light elements. The support element 22 is provided to arrange the light element 18 and the additional light elements at a uniform distance. The support element 22 is connected to the light element 18 and a multiplicity of the additional light elements in a bonded manner. In the present case the support element 22 is connected to the light element 18 and to at least four additional light elements. In the present case the support element 22 is connected to five light elements. In the present case, five light elements are arranged on the support element 22. The support element 22 is embodied in longitudinal form and has a longitudinal extension. The support element 22 is embodied in a strip-like form. The support element 22 is partially embodied from a flexible and partially from a rigid material. The support element 22 is partially embodied from an insulating material. The support element 22 is embodied from an epoxy resin. In addition, the support element 22 is partially embodied from a conductive material. The support element 22 is partially embodied from copper. The support element 22 is embodied as a printed circuit board (PCB). Alternatively, the support element can be connected to more than five light elements or fewer than five light elements, wherein the light elements could be arranged with an irregular spacing and embodied from a different conductive material, such as for example iron or aluminum, and from another insulating material, such as for example mica. It is further conceivable to manufacture a support element completely from an elastic or inelastic material. It is also conceivable to embody a support element in a flat form.

The cooking device has at least one further light unit 24. The further light unit 24 comprises at least one further light element 20 and additional further light elements embodied in a structurally identical manner to the further light element 20, and a further support element 32. The further light unit 24 is embodied in a structurally identical manner to the light unit 10. The description of the light unit 10 can thus be transferred to the further light unit 24, for which reason a further description of the further light unit 24 can be dispensed with.

The light unit 10 and the further light unit 24 are arranged mirror-symmetrically relative to each other. The light unit 10 and the further light unit 24 are arranged parallel to each other. Alternatively, the light units could be embodied in flat form and arranged perpendicularly to each other and/or enclose an angle diverging from a perpendicular arrangement to each other. It is also conceivable to arrange light units at least partially one above the other and/or embody light units differing from each other.

In addition a cooking device can have at least two additional or a multiplicity of light units, in particular embodied in a structurally identical manner to the light unit 10, wherein additional light units in particular can be embodied parallel to the light unit 10 and viewed in an installation position arranged vertically and preferably horizontally offset relative to this. In addition, additional light units can be arranged parallel to and/or perpendicular to and at an angle diverging from a right angle relative to each other and in particular embodied in a structurally non-identical manner to each other.

The cooking device has an insulation unit 12. The insulation unit 12 is arranged in the housing unit 40. The insulation unit 12 is arranged between the electronics unit 38 and the heating unit 36 (cf. FIGS. 1 and 2). The insulation unit 12 is arranged underneath the heating unit 36. The insulation unit 12 is arranged underneath the mounting and/or shield plate 50. The insulation unit 12 is arranged around the light unit 10. The insulation unit 12 is in contact with the light unit 10 from two oppositely facing sides. The insulation unit 12 is provided to electrically insulate the light unit 10. The insulation unit 12 is provided to insulate the light unit 10 electrically from the electronics unit 38. The insulation unit 12 is provided to insulate the light unit 10 electrically from the mounting and/or shield plate 50. The insulation unit 12 is provided for thermal insulation of the light unit 10. For electrical insulation of the light unit 10 the insulation unit 12 comprises two insulation elements 14, 16, in particular a first insulation element 14 and a second insulation element 16.

In addition a cooking device can have additional insulation units embodied in a structurally identical manner to the insulation unit 12, wherein additional insulation units in particular are embodied parallel to the insulation unit 12 and viewed in an installation position can be arranged vertically and/or preferably horizontally offset relative to this. In addition, additional insulation units can in particular be embodied in a structurally non-identical manner to each other and/or to the insulation unit 12 and differ, for example in the number and/or form of structural recesses and/or of light recesses, in their material and/or a dimension.

The first insulation element 14 has an at least essentially rectangular profile. The first insulation element 14 is embodied in flat form. The first insulation element 14 is embodied in pancake design. The first insulation element 14 is embodied as a disk. The first insulation element 14 is manufactured from an electrically insulating material. The first insulation element 14 is manufactured from a sheet silicate. The first insulation element 14 is manufactured from mica. The first insulation element 14 is embodied in one piece and in each case produced from a single piece of material. The first insulation element 14 has a material thickness between 0.2 mm and 0.5 mm. The first insulation element 14 has a structural recess 44. In the present case the structural recess 44 is embodied as a circular structural recess 44. The structural recess 44 is embodied as an opening. The structural recess 44 is provided at least to surround mechanical components of the cooking device, which are not shown here, for easier assembly when assembling the first insulation element 14. The first insulation element 14 has further structural recesses, which are embodied in a structurally identical manner to the structural recess 44 and are arranged along a main extension direction 48 of the first insulation elements 14.

The first insulation element 14 is arranged in the housing unit 40 (cf. FIG. 2). The first insulation element 14 is arranged between the heating unit 36 and the electronics unit 38. The first insulation element 14 is arranged underneath the heating unit 36. The first insulation element 14 is arranged underneath the mounting and/or shield plate 50. The first insulation element 14 is arranged above the electronics unit 38. The first insulation element 14 is arranged underneath the light unit 10. The first insulation element 14 is provided to electrically insulate the light unit 10 from a lower area of the cooking device. The first insulation element 14 is provided to electrically insulate the light unit 10 from the electronics unit 38. The first insulation element 14 is in contact with the light unit 10 in a peripheral area of the first insulation element 14. The first insulation element 14 is connected to the light unit 10 in a force- and/or form-fitted manner. The first insulation element 14 is arranged underneath the support element 22. The first insulation element 14 is in contact with the support element 22. The first insulation element 14 is in contact with the support element 22 in a peripheral area of the first insulation element 14. The first insulation element 14 is connected to the support element 22 in a force- and/or form-fitted manner. The first insulation element 14 is provided to electrically insulate the support element 22 from a lower area of the cooking device.

The first insulation element 14 is arranged underneath the further light unit 24. The first insulation element 14 is provided to electrically insulate the further light unit 24 from the lower area of the cooking device. The first insulation element 14 is provided to electrically insulate the further light unit 24 from the electronics unit 38. The first insulation element 14 is in contact with the further light unit 24 in a further peripheral area of the first insulation element 14 lying opposite to the peripheral area. The first insulation element 14 is connected to the further light unit 24 in a force- and/or form-fitted manner. The first insulation element 14 is arranged underneath the further support element 32 of the further light unit 24. The first insulation element 14 is in contact with the further support element 32. The first insulation element 14 is in contact with the further support element 32 in a further peripheral area of the first insulation element 14 lying opposite to the peripheral area. The first insulation element 14 is connected to the further support element 32 in a force- and/or form-fitted manner.

The second insulation element 16 is largely embodied in a structurally identical manner to the first insulation element 14. The second insulation element 16 has at least essentially a rectangular profile. The second insulation element 16 is embodied in flat form. The second insulation element 16 is embodied in pancake design. The second insulation element 16 is embodied as a disk. The second insulation element 16 is manufactured from an electrically insulating material. The second insulation element 16 is manufactured from a sheet silicate. The second insulation element 16 is manufactured from mica. The second insulation element 16 is embodied in one piece and in each case produced from a single piece of material. The second insulation element 16 has a material thickness between 0.2 mm and 0.5 mm. The second insulation element 16 in each case has a further structural recess 46. In the present case the further structural recess 46 is embodied as a circular structural recess. The structural recess 46 is embodied as an opening. The structural recess 46 is provided at least to surround mechanical components of the cooking device, which are not shown here, for easier assembly when assembling the first insulation element 16. In addition the second insulation element 16 has additional further structural recesses, which are embodied in structurally identical form to the further structural recess 46 and are arranged along the main extension direction 48.

The second insulation element 16 is arranged in the housing unit 40 (cf. FIG. 2). The second insulation element 16 is arranged between the heating unit 36 and the electronics unit 38. The second insulation element 16 is arranged underneath the heating unit 36. The second insulation element 16 is arranged underneath the mounting and/or shield plate 50. The second insulation element 16 is arranged above the electronics unit 38. The second insulation element 16 is arranged above the light unit 10. The second insulation element 16 is provided to electrically insulate the light unit 10 from an upper area of the cooking device. The second insulation element 16 is provided to electrically insulate the light unit 10 from the mounting and/or shield plate 50. The second insulation element 16 is in contact with the light unit 10 in a peripheral area of the second insulation element 16.

The second insulation element 16 is connected to the light unit 10 in a force- and/or form-fitted manner. The second insulation element 16 is arranged above the support element 22. The second insulation element 16 is in contact with the support element 22. The second insulation element 16 is connected to the support element 22 in a force- and/or form-fitted manner. The second insulation element 16 is arranged above the first insulation element 14. The second insulation element 16 is arranged parallel to the first insulation element 14.

The second insulation element 16 is arranged above the further light unit 24 (cf. FIG. 3). The second insulation element 16 is provided to electrically insulate the further light unit 24 from the upper area of the cooking device. The second insulation element 16 is provided to electrically insulate the further light unit 24 from the mounting and/or shield plate 50. The second insulation element 16 is in contact with the further light unit 24 in a further peripheral area of the second insulation element 16 lying opposite to the peripheral area. The second insulation element 16 is connected to the further light unit 24 in a force- and/or form-fitted manner. The second insulation element 16 is arranged above the further support element 32 of the further light unit 24. The second insulation element 16 is in contact with the further support element 32. The second insulation element 16 is connected to the further support element 32 in a force- and/or form-fitted manner.

The two insulation elements 14, 16 surround the light unit 10 at least from two oppositely facing sides of the light unit 10. The two insulation elements 14, 16 surround the light unit 10 at least in a peripheral area of the insulation unit 12. The two insulation elements 14, 16 surround the further light unit 24 from at least two oppositely facing sides of the further light unit 24. The two insulation elements 14, 16 surround the further light unit 24 at least in a further peripheral area of the insulation unit 12 lying opposite to the peripheral area.

Figure 4:
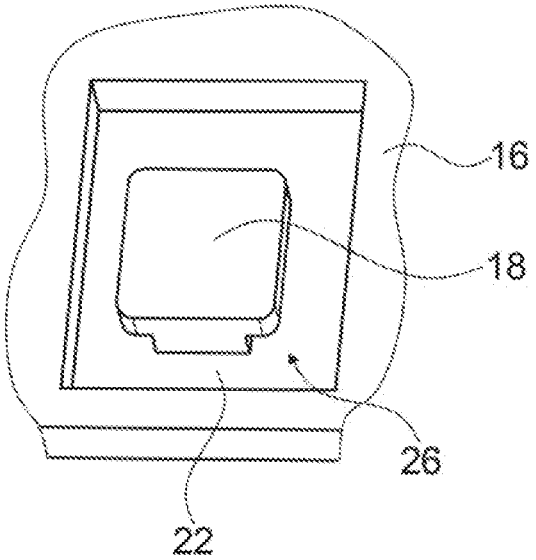

The second insulation element 16 has a light recess 26. The light recess 26 is arranged in the peripheral area of the second insulation element 16. As the detail view in FIG. 4 shows, the light recess 26 has a profile which is matched to a profile of the light element 18 of the light unit 10, for example in particular in terms of shape and/or diameter. The light recess 26 is assigned to the light element 18. The light recess 26 surrounds the light element 18. The light recess 26 is provided to allow the passage of light energy from the light element 18 for an illumination function of the cooking device. Alternatively, a light recess can be arranged at a distance from a light element. Additionally, the profile of light recesses may not be matched to a light element. A second insulation element could further be devoid of light recesses and have transparent areas for the light from a light element.

The second insulation element 16 has a further light recess 28. The further light recess 28 is arranged in the further peripheral area of the second insulation element 16. The further light recess 28 is embodied in structurally identical form to the light recess 26. The further light recess 28 is assigned to the further light element 20 of the further light unit 24. The second insulation element 16 has additional further light recesses, which are in each case assigned to an additional further light element of the further light unit 24. According to FIG. 4 the profiles of the additional further light recesses are matched to profiles of the additional further light elements of the further light unit 24.

The invention claimed is:

1. A cooking device, comprising:

a light unit including at least one light element coupled to a printed circuit board; and an insulation unit configured to electrically insulate the light unit and including a first insulation element disposed underneath the printed circuit board and a second insulation element disposed above the printed circuit board, said light unit being at least partially arranged between the first and second insulation elements.

2. The cooking device of claim 1, wherein at least one of the first and second insulation elements is embodied in flat form with a maximum material thickness of at most 2 mm.

3. The cooking device of claim 1, wherein the light unit is configured to include a light element, at least one of the first and second insulation elements, and a light recess assigned to the light element.

4. The cooking device of claim 1, wherein at least one of the first and second insulation elements is in contact with the light unit.

5. The cooking device of claim 1, wherein the first and second insulation elements are arranged at least essentially parallel to each other.

6. The cooking device of claim 1, wherein at least one of the first and second insulation elements is embodied in one piece.

7. The cooking device of claim 1, wherein the first and second insulation elements are embodied at least essentially in a structurally identical manner to each other.

8. The cooking device of claim 1, wherein at least one of the first and second insulation elements is embodied at least partially from mica.

9. The cooking device of claim 1, wherein the light unit comprises a support element, which is embodied in at least partially strip-like form, and a multiplicity of light elements, which are arranged on the support element.

10. The cooking device of claim 1, further comprising a further light unit, which is embodied at least essentially in a structurally identical manner to the light unit.

11. A cooking appliance, comprising a cooking device, said cooking device comprising a light unit including at least one light element coupled to a printed circuit board, and an insulation unit configured to electrically insulate the light unit and including a first insulation element disposed underneath the printed circuit board and a second insulation element disposed above the printed circuit board, said light unit being at least partially arranged between the first and second insulation elements.

12. The cooking appliance of claim 11, wherein at least one of the first and second insulation elements is embodied in flat form with a maximum material thickness of at most 2 mm.

13. The cooking appliance of claim 11, wherein the light unit is configured to include a light element, at least one of the first and second insulation elements, and a light recess assigned to the light element.

14. The cooking appliance of claim 11, wherein at least one of the first and second insulation elements is in contact with the light unit.

15. The cooking appliance of claim 11, wherein the first and second insulation elements are arranged at least essentially parallel to each other.

16. The cooking appliance of claim 11, wherein at least one of the first and second insulation elements is embodied in one piece.

17. The cooking appliance of claim 11, wherein the first and second insulation elements are embodied at least essentially in a structurally identical manner to each other.

18. The cooking appliance of claim 11, wherein at least one of the first and second insulation elements is embodied at least partially from mica.

19. The cooking appliance of claim 11, wherein the light unit comprises a support element, which is embodied in at least partially strip-like form, and a multiplicity of light elements, which are arranged on the support element.

20. The cooking appliance of claim 11, wherein the cooking device incudes a further light unit, which is embodied at least essentially in a structurally identical manner to the light unit.

21. A method for production of a cooking device, said method comprising arranging a light unit including at least one light element coupled to a printed circuit board at least partially between at least two insulation elements of an insulation unit, such that a first insulation element is disposed underneath the printed circuit board and a second insulation element is disposed above the printed circuit board.

22. The method of claim 21, further comprising configuring at least one of the two insulation elements in flat form with a maximum material thickness of at most 2 mm.

23. The method of claim 21, further comprising configuring the light unit to include a light element, at least one of the two insulation elements, and a light recess assigned to the light element.

24. The method of claim 21, further comprising establishing a contact of at least one of the two insulation elements with the light unit.

25. The method of claim 21, further comprising arranging the two insulation elements at least essentially parallel to each other.

26. The method of claim 21, further comprising forming at least one of the two insulation elements in one piece.

27. The method of claim 21, wherein the two insulation elements are embodied at least essentially in a structurally identical manner to each other.

28. The method of claim 21, wherein at least one of the two insulation elements is embodied at least partially from mica.

29. The method of claim 21, further comprising arranging a multiplicity of light elements on an at least partially strip-like support element of the light unit.

* * * * *